US008590804B2

(12) United States Patent
Muggli et al.

(10) Patent No.: US 8,590,804 B2
(45) Date of Patent: Nov. 26, 2013

(54) TWO STAGE KINETIC ENERGY SPRAY DEVICE

(75) Inventors: Felix Muggli, Winterthur (CH); Marc Heggemann, Winterthur (CH); Ronald J. Molz, Westbury, NY (US)

(73) Assignee: Sulzer Metco (US) Inc., Westbury, NY (US)

( * ) Notice: Subject to any disclaimer, the term of this patent is extended or adjusted under 35 U.S.C. 154(b) by 663 days.

(21) Appl. No.: 12/739,621

(22) PCT Filed: Oct. 23, 2008

(86) PCT No.: PCT/US2008/012024

§ 371 (c)(1),
(2), (4) Date: Sep. 13, 2010

(87) PCT Pub. No.: WO2009/054975

PCT Pub. Date: Apr. 30, 2009

(65) Prior Publication Data

US 2010/0330291 A1 Dec. 30, 2010

Related U.S. Application Data

(63) Continuation-in-part of application No. 11/923,298, filed on Oct. 24, 2007, now Pat. No. 7,836,843.

(51) Int. Cl.

| | |
|---|---|
| ***B05C 5/04*** | (2006.01) |
| ***B05C 19/00*** | (2006.01) |
| ***B05B 7/00*** | (2006.01) |
| ***B05B 7/16*** | (2006.01) |
| ***B05D 1/12*** | (2006.01) |

(52) U.S. Cl.
USPC ..... 239/8; 239/79; 239/434.5; 239/590.5; 118/308; 427/180

(58) Field of Classification Search
USPC ..... 239/8, 13, 79, 85, 135, 398, 434.5, 589, 239/590.5, 594; 118/308; 427/180; 219/121.47, 125.5, 121.5
See application file for complete search history.

(56) References Cited

U.S. PATENT DOCUMENTS

| | | | | |
|---|---|---|---|---|
| 4,807,814 | A * | 2/1989 | Douche et al. | 239/428 |
| 4,982,067 | A | 1/1991 | Marantz et al. | |
| 5,302,414 | A | 4/1994 | Alkhimov et al. | |
| 6,082,635 | A | 7/2000 | Seiner et al. | |
| 6,663,013 | B1 | 12/2003 | Vanden Heuvel et al. | |
| 2004/0018317 | A1 * | 1/2004 | Heinrich et al. | 427/446 |
| 2006/0038044 | A1 * | 2/2006 | Van Steenkiste et al. | 239/594 |
| 2006/0201418 | A1 * | 9/2006 | Ko et al. | 118/308 |
| 2007/0138147 | A1 | 6/2007 | Molz et al. | |
| 2007/0243335 | A1 * | 10/2007 | Belashchenko | 427/451 |

* cited by examiner

*Primary Examiner* — Darren W Gorman
(74) *Attorney, Agent, or Firm* — Greenblum & Bernstein, P.L.C.

(57) ABSTRACT

A two stage kinetic energy spray device has a first stage first nozzle having a receiving end that receives a particulate stream, an injection end located axially to the first nozzle receiving end, the injection end receiving the particulate stream from the receiving end. A second stage has a second nozzle, the second nozzle having a gas receiving portion that receives an effluent gas, a convergent portion that is downstream from the gas receiving portion and a divergent portion that is downstream from the convergent portion, the convergent portion and the divergent portion meeting at a throat. The particle stream is accelerated to a first velocity in the first nozzle located within the second nozzle divergent portion The effluent gas is accelerated to a second velocity in the second nozzle. First nozzle injection end chevrons allow mixing of particulate and supersonic effluent streams prior to exiting the spray device.

18 Claims, 8 Drawing Sheets

TWO STAGE KINETIC ENERGY SPRAY DEVICE

CROSS-REFERENCE TO RELATED APPLICATIONS

This application claims priority to U.S. Ser. No. 11/923,298 filed Oct. 24, 2007, incorporated herein by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The invention relates generally to apparatus and methods relating to the application of coatings, and more particularly to a two-stage kinetic energy spray device.

2. Description of Related Art

Thermal spraying is generally described as a coating method in which powder or other feedstock material is fed into a stream of energized gas that is heated, accelerated, or both heated and accelerated. The feedstock material becomes entrapped by the stream of energized gas, from which the feedstock material receives thermal and/or kinetic energy. This absorbed thermal or kinetic energy softens and energizes the feedstock. The energized feedstock is then impacted onto a surface where it adheres and solidifies, forming a relatively thick thermally sprayed coating by the repeated cladding of subsequent thin layers.

Conventional cold spray devices either inject the powder feedstock before or after the throat of a Laval type convergent/divergent nozzle. When the feedstock is injected before the nozzle it is typically performed in an axial orientation at or near the beginning of the convergent nozzle section, and the powder feedstock is heated and accelerated through the Laval nozzle. This allows the particles to have a relatively uniform acceleration profile, however the particles are also subjected to the same elevated gas temperatures that are required for optimal performance of the Laval nozzle since the gas velocity is a function of the square root of the gas temperature. These optimal temperatures, typically in excess of 500 C., pre-soften the powder feedstock which can and often results in the powder sticking to the nozzle walls at the throat. Another limitation is that the particle temperature cannot be independently controlled since the gas temperature directly controls both the particle velocity and the particle temperature.

Injection of the feedstock after the throat is performed radially anywhere along the divergent section of the nozzle. This method has the advantages of not loading the nozzle throat with powder as well as providing some independence to the particle temperature because the powder feedstock is injected when the gas is expanding and cooling rapidly. A significant disadvantage is that the powder feedstock is injected into a supersonic gas stream and the difference in velocity between the gas and the particles results in considerable and significant drag heating and energy waste. The result is that a measureable portion of the kinetic gas energy is transferred into heat both in the gas and the particles.

Accordingly, the greater the difference in velocities between the particles and the gas, the wasted kinetic energy increases exponentially.

It has been previously recognized that, in the case of some thermal spray applications, injecting feedstock axially into an energized gas stream presents certain advantages over other feedstock injection methods. Typically, feedstock is fed into a stream in a direction generally described as radial injection. In other words, in a direction that is generally perpendicular to the general direction of travel of the gaseous stream. Radial injection is commonly used as it provides an effective means of mixing particles into an effluent stream and thus transferring the energy to the particles in a short span. This is the case with plasma where short spray distances and high thermal loading require rapid mixing and energy transfer for the process to apply coatings properly. Axial injection can provide advantages over radial injection due to the potential to better control the linearity and the direction of feedstock particle trajectory when axially injected. Other advantages include having the particulate in the central region of the effluent stream, where the energy density is likely to be the highest, thus affording the maximum potential for energy gain into the particulate. Still further, axial injection tends to disrupt the effluent stream less than radial injection techniques currently practiced.

Accordingly, in many thermal spray process guns, axial injection of feedstock particles is preferred for the injection of particles, using a carrier gas, into the heated and/or accelerated gas simply referred to in this disclosure as effluent. The effluent can be plasma, electrically heated gas, combustion heated gas, cold spray gas, or combinations thereof. Energy is transferred from the effluent to the particles in the carrier gas stream. Due to the nature of stream flow and two phase flow, this mixing and subsequent transfer of energy is limited in axial flows and requires that the two streams, effluent and particulate bearing carrier, be given sufficient time and travel distance to allow the boundary layer between the two flows to break down and thus permit mixing. During this travel distance, energy is lost to the surroundings through heat transfer and friction, resulting both in lost efficiency and the slowing down of the mixed-flow. Many thermal spray process guns that do utilize axial injection are then designed longer than would normally be required to allow for this mixing and subsequent energy transfer.

These limitations to mix the particulate bearing carrier and effluent streams becomes even more pronounced when the particulate-bearing carrier fluid is a liquid, and, in many cases, they have prevented the effective use of liquid feeding into axial injection thermal spray process guns. For liquid injection techniques the use of gas atomization to produce fine droplet streams aids in getting the liquid to mix with the effluent stream more readily to enable liquid injection to work at all. However, this method still requires some considerable distance to allow the gas and fine droplet stream and effluent stream to mix and transfer energy. This method also produces a certain amount of turbulence in the stream flows.

Attempts at promoting mixing such as introduction of discontinuities and impingement of the flows also produces turbulence. Radial injection, commonly used with thermal spray processes such as plasma to ensure mixing in a short distance also produces turbulence as the two streams intersect at right angles. In fact, most acceptable methods of injection that promote rapid mixing currently use methods that deliberately introduce turbulence as the means to promote the mixing. The turbulence serves to break down the boundary layer between the flows and once this is accomplished mixing can occur.

The additional turbulence often results in unpredictable energy transfer between the effluent and particulate bearing carrier stream because the flow field is constantly in flux. This additional turbulence produces variations within the flow field that affect the transfer of energy. Turbulence represents a chaotic process and causes the formation of eddies of different length scales. Most of the kinetic energy of the turbulent motions is contained in the large scale structures. The energy "cascades" from the large scale structures to smaller scale structures by an inertial and essentially inviscid mechanism. This process continues creating smaller and smaller structures which produces a hierarchy of eddies. Eventually this process creates structures that are small enough that molecular diffusion becomes important and viscous dissipation of energy finally takes place. The scale at which this happens is in the Kolmogorov length scale. In this manner the turbulence results in conversion of some of the kinetic energy to thermal energy. The result is a process that produces more thermal energy rather than kinetic energy for transfer to the particles, limiting the performance of such devices. Complicate the process by having more than one turbulent stream and the results are unpredictable as stated.

Turbulence also increases energy loss to the surroundings because turbulence results in loss of at least some of the boundary layer in the effluent flow field and thus promotes the transfer of energy to the surroundings as well as frictional affects within the flow when flows are contained within walls. For flow in a tube the pressure drop for a laminar flow is proportional to the velocity of the flow. In contrast, for turbulent flow the pressure drop is proportional to the square of the velocity. This gives a good indication of the scale of the energy loss to the surroundings and internal friction.

The original design of a cold spray gun was patented as U.S. Pat. No. 5,302,414, utilizing a single convergent/divergent nozzle to accelerate a stream of particles injected into a flow of gas that is then passed through the nozzle. The gas flow was heated to further increase the velocity. This velocity increase of the gas was preferably a result of the relationship that gas velocity is proportional to the square root of the gas temperature.

BRIEF SUMMARY OF THE INVENTION

Accordingly, there is a need in the art for an improved method and apparatus to promote rapid mixing of axially injected matter into thermal spray process guns, that limits the generation of turbulence in the flow streams as a result, and improves the kinetic efficiency of the mixed stream.

The invention as described provides an improved apparatus and method for promoting mixing of axially fed particles in a carrier stream with a heated and/or accelerated effluent stream with increased efficiency and without introducing significant turbulence into either the effluent or carrier streams. Embodiments of the invention utilize a thermal spray apparatus having a first nozzle with an axial injection port a nozzle end with or without chevrons, set into a second nozzle for the introduction of effluent gas, whereby the particulate nozzle end injects the particle stream downstream of the throat of the second nozzle. For purposes of this application, the term 'chevron nozzle' may include any circumferentially non-uniform type of nozzle.

A two stage kinetic energy spray device has a first stage having a first nozzle, the first nozzle having a first nozzle receiving end that receives a feedstock and carrier gas stream, and a first nozzle injection end located axially to the first nozzle receiving end, the first nozzle injection end receiving the feedstock and carrier gas stream from the first nozzle receiving end, a cross-section of the receiving end being larger than a cross-section of the injection end; a second stage having a second nozzle, the second nozzle having a gas receiving portion that receives an effluent gas, a convergent portion that is downstream from the gas receiving portion and a divergent portion that is downstream from the convergent portion, the convergent portion and the divergent portion meeting at a throat; wherein the first nozzle is located within the second nozzle; wherein the particle stream is accelerated to a first velocity in the first nozzle; wherein the effluent gas is accelerated to a second velocity in the second nozzle; and wherein the first nozzle injection end is located in the second nozzle divergent portion.

Stated differently, a two stage kinetic energy spray device has a first stage having a first nozzle, the first nozzle having a first nozzle receiving end that receives a feedstock and carrier gas stream, and a first nozzle injection end located axially to the first nozzle receiving end, the first nozzle injection end receiving the feedstock and carrier gas stream from the first nozzle receiving end, and the cross-section of the receiving end is larger than the cross-section of the injection end. This first nozzle is generally set axially into a second nozzle. The second stage has the second nozzle, and the second nozzle has a gas receiving portion that receives an effluent gas, a convergent portion that is downstream from the gas receiving portion and a divergent portion that is downstream from the convergent portion. The convergent portion and the divergent portion meeting at a throat. The effluent gas enters the gas receiving portion radially, and transitions to axial movement as the gas enters the convergent portion. The gas then accelerates. In one embodiment, the second nozzle convergent/divergent portion is a form of a de Laval nozzle. The particle stream is accelerated to a first velocity in the first nozzle, and the effluent gas is accelerated to a second velocity in the second nozzle. In one embodiment the particle stream in the first nozzle is accelerated to subsonic speed or sonic speed, and the gas in the second nozzle is accelerated to supersonic speed. It should be noted that these speeds are relative to mach, that is, the actual speed of sound under the local conditions of temperature, pressure and the composition of the medium. For mixing purposes and to maximize the transfer of kinetic energy, the first nozzle injection end is located in the second nozzle divergent portion. In one embodiment, this location is just past the throat.

In another embodiment, a method of forming a coating using a two stage kinetic energy spray device comprises the steps of: receiving a feedstock and carrier gas stream at a first nozzle receiving end; axially transmitting the feedstock and carrier gas stream through a first nozzle; receiving the feedstock and carrier gas stream at a first nozzle injection end; injecting the feedstock and carrier gas stream from the first nozzle injection end; optionally heating an effluent gas; receiving the effluent gas at a second nozzle gas receiving portion; accelerating the effluent gas through a convergent portion of the second nozzle, the convergent portion downstream from the gas receiving portion; accelerating the effluent gas through a divergent portion of the second nozzle that is downstream from the convergent portion, the convergent portion and the divergent portion meeting at a throat; and mixing the feedstock and carrier gas stream with the effluent gas; wherein a cross-section of the receiving end being larger than a cross-section of the injection end; wherein the first nozzle is located inside the second nozzle; wherein the particle stream is accelerated to a first velocity in the first nozzle; wherein the effluent gas is accelerated to a second velocity in the second nozzle; and wherein the first nozzle injection end is located in the second nozzle divergent portion.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the present invention, examples of which are illustrated in the accompanying drawings.

Figure 1:
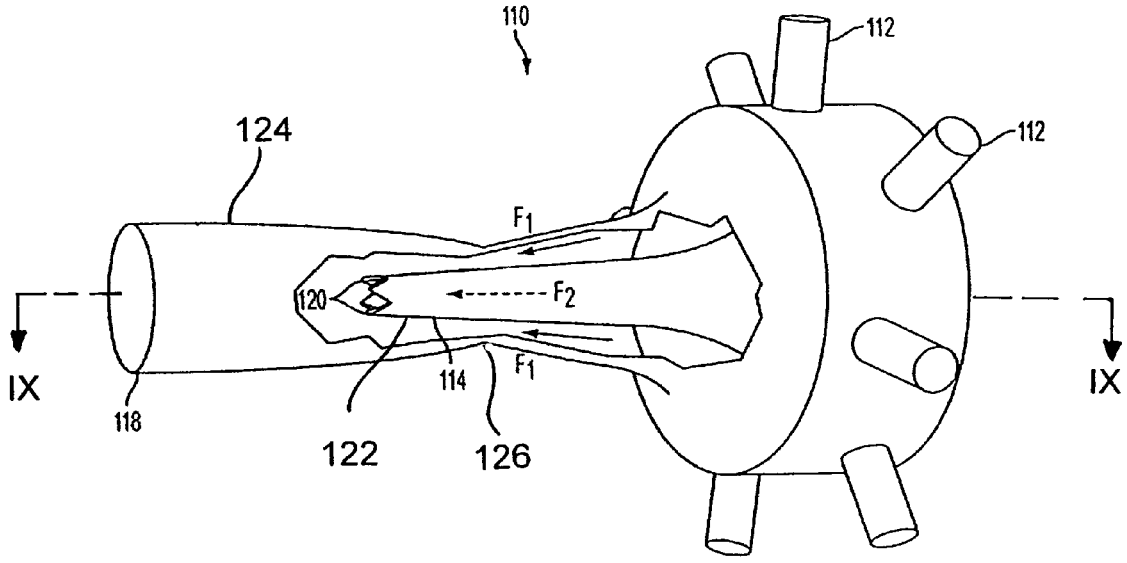
FIG. 1 is a cut-away perspective view of the exit nozzle regions of a kinetic thermal spray gun in accordance with an embodiment of the invention.

FIG. 1 provides a cut-away schematic view of the kinetic gun 110 and divergent exit nozzle 118 regions of a kinetic spray gun. Axial injection port 114 is shown with a plurality of chevrons 120 at the distal end of the port defining an outlet. Each of the chevrons is generally triangular in configuration. The chevrons 120 are located radially—and in some embodiments equally spaced—around the circumference of the distal end of the axial injection port 114. Introducing the chevrons 120 to the axial injection port 114 increases mixing between the two flow streams $F_1$ and $F_2$ as they meet. The energy of the effluent stream passing through the kinetic gun 110 and accelerated in the nozzle 118 more readily transfers the thermal and kinetic characteristics of the effluent flow to the carrier flow and particulate with the use of these chevrons.

Figure 2:
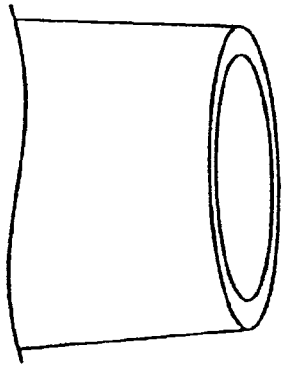
FIG.2 PRIOR ART
FIG. 2 is a perspective view of a first injection nozzle in accordance with an embodiment of the invention.
Figure 3:
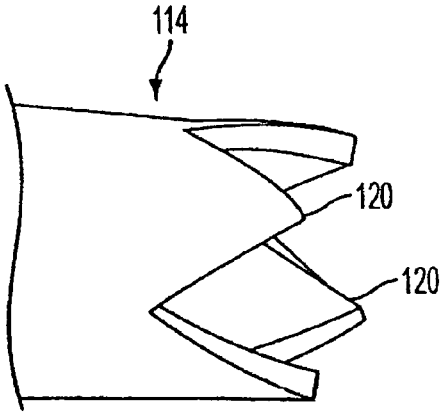
FIG. 3 is a perspective view of a first injection nozzle with chevrons in accordance with an embodiment of the invention.

FIG. 2 provides a perspective view of a first injection nozzle in accordance with an embodiment of the invention having a conventional axial injection port distal end. In contrast, FIG. 3 provides perspective view of a first injection nozzle with chevrons in accordance with an embodiment of the invention showing the distal end of axial injection port 114 including four chevrons 120 according to an embodiment of the present invention. In some embodiments, each chevron 120 includes a generally triangular shaped extension of the axial injection port 114. In the embodiment of FIG. 3, each chevron 120 is generally parallel to the wall of the axial injection port 114 to which the chevron is joined. Another embodiment, shown in FIG. 4, incorporates chevrons 130 that are flared, curved bent, or otherwise directed radially outward relative to the plane defining the distal end of the axial injection port 114. In another embodiment, the chevrons may be flared, curved, bent, or otherwise directed radially inward relative to the plane defining the distal end of the axial injection port. Angles of inclination for the chevrons up to 90 degrees inward or outward will provide enhanced mixing, while preferred inclination angles may be between 0 and about 20 degrees. Inclination angles higher than about 20 degrees, although providing enhanced mixing, may also tend to produce undesirable eddy currents and the possibility of turbulence depending upon the relative flow velocities and densities.

Figure 4:
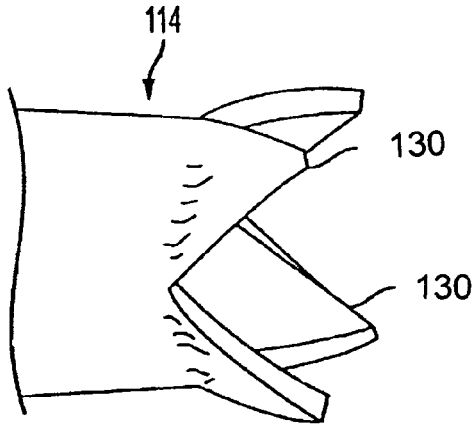
FIG. 4 is a perspective view of a first injection nozzle with flared chevrons in accordance with an embodiment of the invention.

While FIG. 4 shows the chevrons 130 equally flared, other contemplated embodiments may have non-symmetrical flared chevrons that can correspond with non-symmetrical gun geometries, compensate for swirling affects often present in thermal spray guns, or other desired asymmetrical needs. In other embodiments different shape and/or arrangement may be used in place of a chevron shapes shown in FIGS. 3 and 4. For purposes of the present application, the term 'chevron nozzle' may also include any circumferentially non-uniform type of nozzle. Non-limiting examples of alternative chevron shapes include radially spaced rectangles, curved-tipped chevrons, semi-circular shapes, and any other shape that can be cut into or attached to the tip that will result in flow mixing or controlled disturbance as discussed below. The chevron pattern may be repeated or a collection of random discontinuities formed by using different shaped chevrons. For purposes of the present application such alternate shapes are included under the general term chevrons. In another embodiment the wall thickness of each chevron may be tapered toward the chevron point.

Almost any number of chevrons can be used to aid in mixing. Four chevrons 120, 130 are shown in the embodiment of FIGS. 3 and 4, respectively. In some embodiments, 4 to as many as 6 chevrons may be ideal for most applications. However, other embodiments may use more or fewer chevrons without departing from the scope of the present invention. For the kinetic thermal spray gun depicted in FIG. 1 the number of chevrons on distal end of axial injection port 114 may coincide with the number of radial injection ports 112 to allow for symmetry in the flow pattern to produce uniform and predictable mixing in the kinetic gun 110.

In some embodiments, the chevrons shown in the various figures are generally a uniform extension of the axial injection port. In other embodiments, chevrons may be retrofit onto existing conventional axial injection ports by, for example, mechanical attachment. Retrofit applications may include use of clamps, bands, welds, rivets, screws or other mechanical attachments known in the art. While the chevrons would typically be made from the same material as the axial injection port, it is not required that the materials be the same. The chevrons may be made from a variety of materials known in the art that are suitable for the flows, temperatures and pressures of the axial feed port environment.

Figure 5:
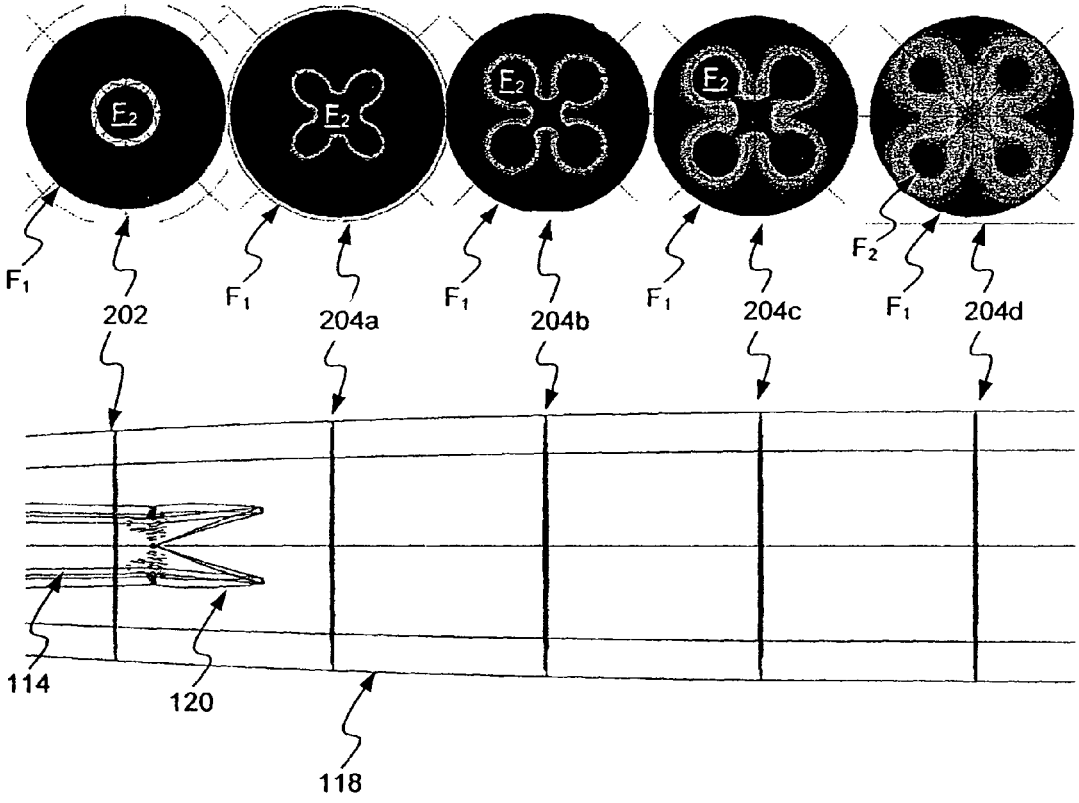
FIG. 5 is a perspective view of the distal end of an axial injection port that includes chevrons according to another embodiment of the invention.

FIG. 5 provides a schematic of various computer-modeled cross-sections of a modeled flow spray path for a thermal spray gun in an embodiment of the present invention. The bottom of the figure shows a side view of the nozzle 118 and axial injection port 114, and above are shown cross-sections 204*a*, 204*b*, 204*c*, 204*d* of the effluent and carrier flow paths at various points. Referring to FIG. 5, as the particulate bearing carrier flow $F_2$ and heated and/or accelerated effluent $F_1$ reach the chevrons 120, the physical differences, such as pressure, density, etc. between the flows causes the boundary between the flows to change from the initial interface shape, shown in cross-section 202—which is typically cylindrical, as dictated by the shape of the axial injection port 114—to a flower-like or asterisk-like shape shown in the cross-section 204*a*, increasing the shared boundary area between flows $F_1$ and $F_2$. The pressure differential that exists between the flows $F_1$ and $F_2$ will cause the higher pressure flow—either the effluent $F_1$ or carrier $F_2$—to accelerate radially in response to the pressure differential (potential flow) as the flows $F_1$ and $F_2$ progress down the length of the chevrons 120 to equalize the pressure. This radial acceleration will also be distorted to drive the flow around the chevron to equalize the pressure under the chevron as well. As shown in the subsequent shape cross-sections 204*b*, 204*c*, and 204*d* this asterisk-like shape continues to propagate as the flows $F_1$ and $F_2$ travel together, further increasing the shared boundary area between flows $F_1$ and $F_2$. Since the mixing of the streams is a function of the boundary area, the increase in boundary area increases the mixing rate as exemplified in FIG. 7. The use of inward or outwardly inclined chevrons increases the mixing affect by increasing the pressure differential between the flows thus causing a more rapid formation and extent to the shaping of the boundary area. The inclination can be either inwardly or outwardly directed depending upon the relative properties of the two streams and the desired affects.

Figure 6:
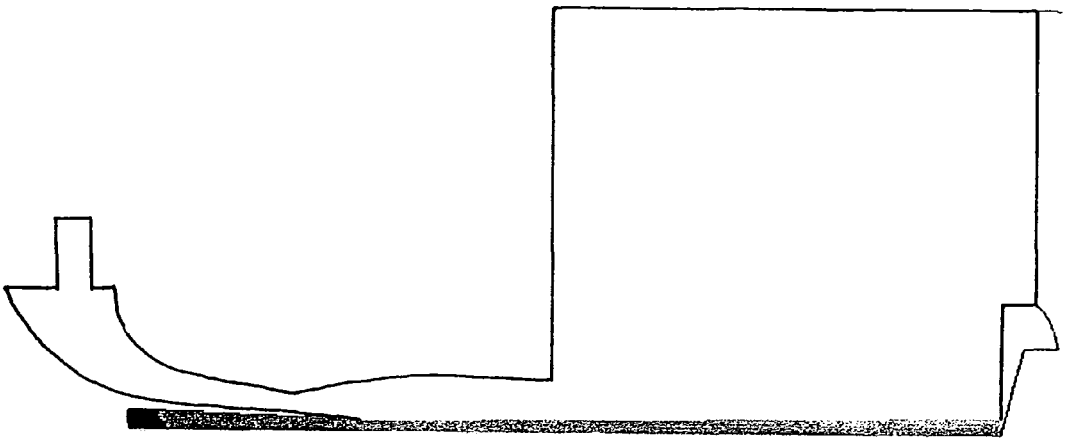
FIG. 6 provides a schematic of an axial injection velocity particle stream without use of chevrons.
Figure 7:
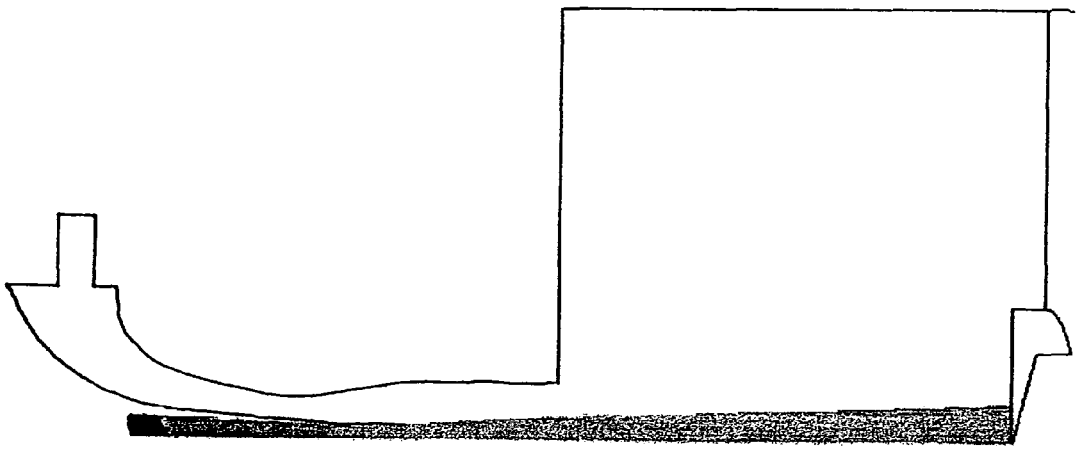
FIG. 7 provides a schematic of an axial injection velocity particle stream with use of non-inclined chevrons according to an embodiment of the present invention.
Figure 8:
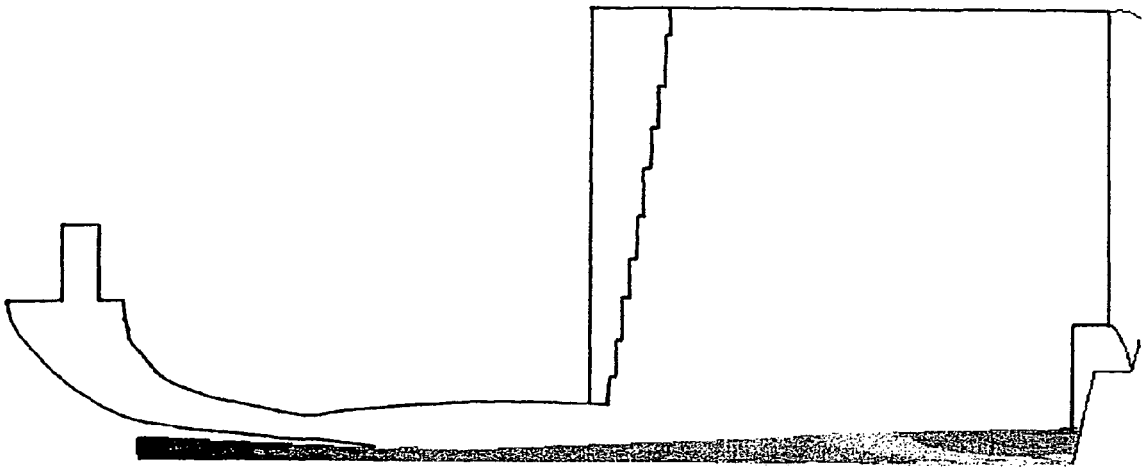
FIG. 8 provide a schematic of an axial injection velocity particle stream with use of 20 degree outward inclined chevrons according to an embodiment of the present invention.

Spray paths exiting nozzle shapes depicted in FIGS. 2, 3, and 4 were modeled in the cold spray gun similar to that depicted in FIG. 1. FIG. 6 provides the results of a computational fluid dynamic (CFD) model run of an axially injected particle velocity stream for a cold spray process as modeled in FIG. 1 without the use of chevrons as depicted in FIG. 2. FIG. 7 provides the results of a CFD model run of an axially injected particle velocity stream for a cold spray process as modeled in FIG. 1 with use of chevrons as depicted in FIG. 3 according to an embodiment of the present invention. Applying CFD modeling to an axial injection cold spray gun has shown measurable improvement in mixing of the particulate bearing carrier stream $F_2$ and heated and/or accelerated effluent stream $F_1$ and in the transfer of energy from the effluent gas directly to the feedstock particles. In FIG. 6, the resulting particle velocities and spray width is smaller than the particle velocities and spray width shown in FIG. 7 as a result of the improved mixing afforded by the addition of the chevrons. Furthermore, FIG. 8 provides the results of a CFD model run of an axially injected particle velocity stream for a cold spray process as modeled in FIG. 1 with use of outwardly inclined chevrons as depicted in FIG. 4 according to an embodiment of the present invention. As shown in FIG. 8, the particle velocities have increased even higher than with straight chevrons (FIG. 7), indicting an even better transfer of energy from the effluent gas to the particles occurred when using the outwardly inclined chevrons. Thus, the introduction of the chevrons, and even more so the inclined chevrons, has increased the overall velocity of the particles and expanded the particle field well into the effluent stream.

Figure 11:
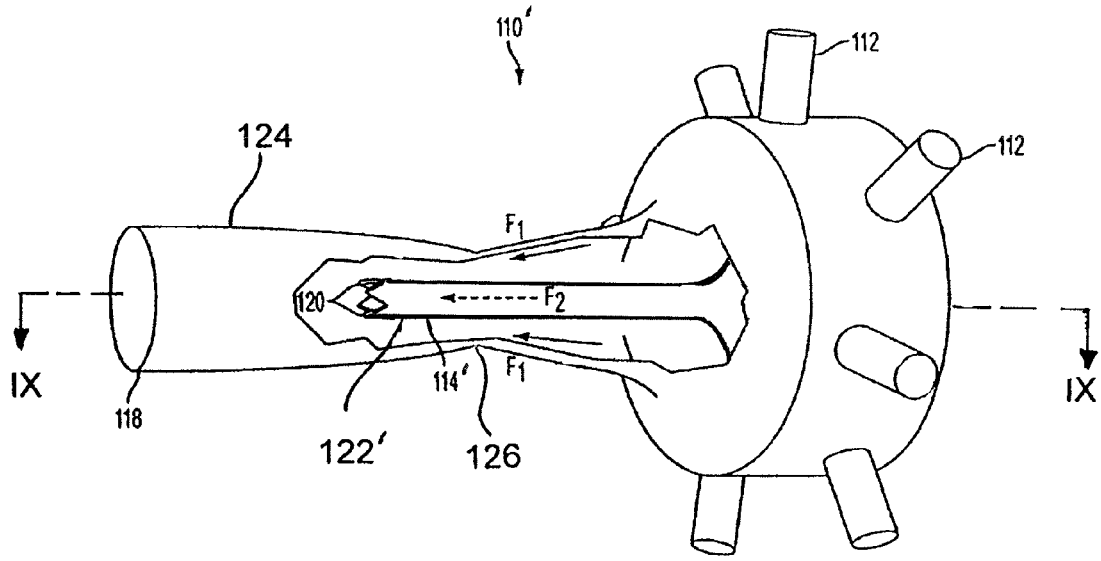
FIG. 11 depicts an alternative embodiment of the kinetic thermal spray gun of FIG. 1 having a first stage with a straight nozzle.

The inclusion of chevrons on axial injection ports can benefit any thermal spray process using axial injection. Thus, embodiments of the present invention are well-suited for axially-fed liquid particulate-bearing streams, as well as gas particulate-bearing streams. In another embodiment, two particulate-bearing streams may be mixed. In still another embodiment two or more gas streams may be mixed by sequentially staging axial injection ports along with an additional stage to mix in a particulate bearing carrier stream. In yet another embodiment, the chevrons can be applied to a port entering an effluent flow at an oblique angle by incorporating one or more chevrons at the leading edge of the port as is enters the effluent stream chamber. In still other embodiments, an alternative kinetic gun 110' can include a first stage 122' having an axial injection port 114' formed as a straight nozzle, as shown in FIG. 11.

In another embodiment, stream mixing in accordance with the present invention may be conducted in ambient air, in a low-pressure environment, in a vacuum, or in a controlled atmospheric environment. Also, stream mixing in accordance with the present invention may be conducted in any temperature suitable for conventional thermal spray processes.

Figure 9:
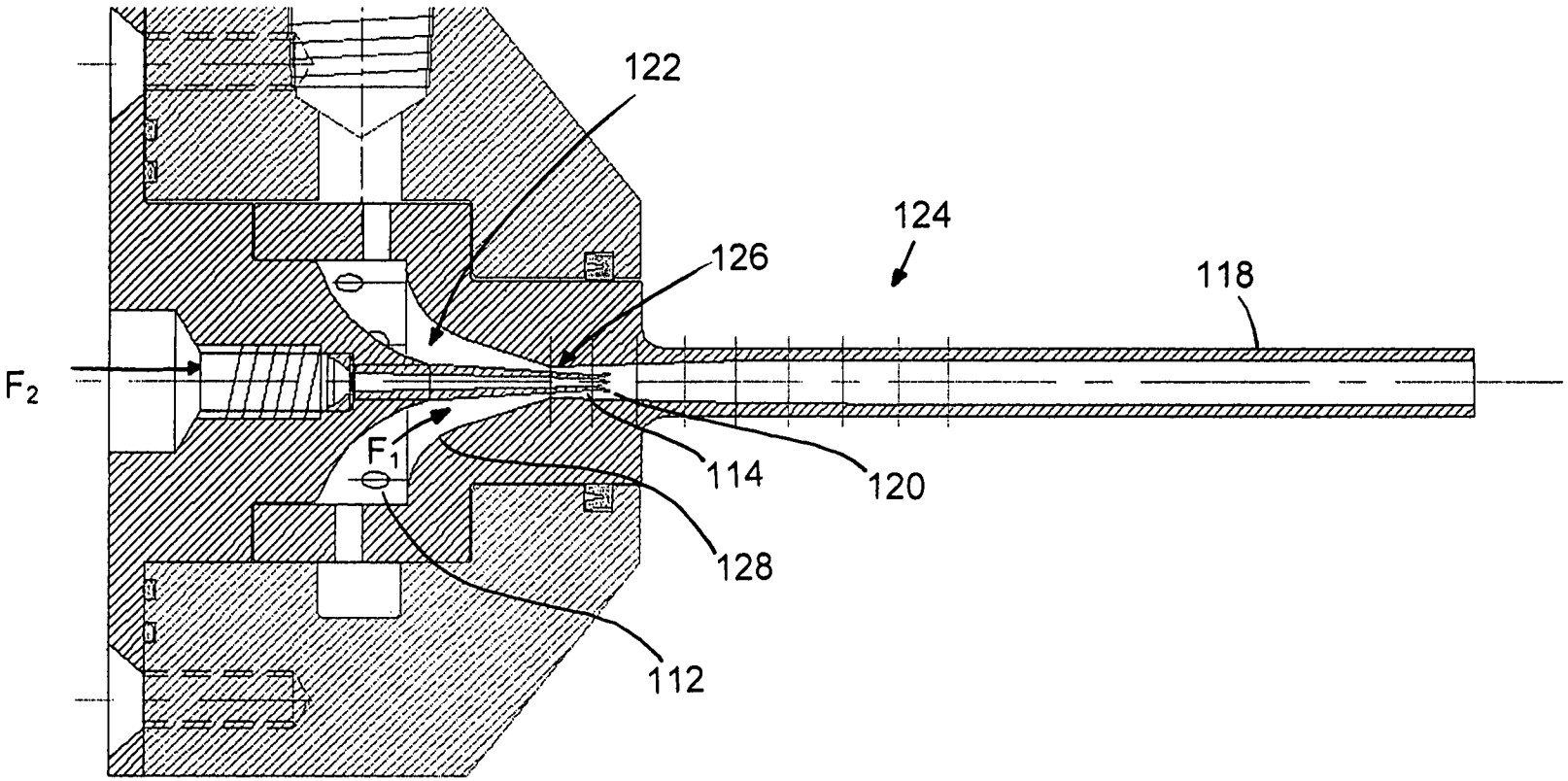
FIG. 9 is a cross-section taken along 10-10 of FIG. 2.

FIG. 9 is a cross-section along IX-IX in FIG. 1. The first stage 122 is the axial injection port where the feedstock and carrier fluid travel and exit into the second stage 124 as a particulate stream and follows path F2. The second stage 124 has the second nozzle 118. A throat 126 in the second stage 124 is a narrowing of the second stage between the ports 112 and the exit nozzle 118. In a preferred embodiment, the second stage 124 is a de Laval nozzle. In this manner, as the gas enters the plurality of ports 112, the gas travels through a funnel shaped portion 128 making the gas radially fed towards the throat 126 following a path of the gas stream F1. As typical of a de Laval nozzle, the gas stream F1 will accelerate upon passing the throat 126, approaching or exceeding supersonic speed.

As can be seen in FIGS. 1 and 9, the first stage 122 is a nozzle located concentrically inside the second stage 124. This positioning of the primary nozzle exit downstream of the secondary nozzle throat also causes a venturi effect of the gas stream F1 in the second stage 124. When assembled, the axial injection port 114 of the first stage 122 is located downstream of the throat 126. In this manner, the gas stream F1 travelling through the de Laval nozzle of the second stage 124 mixes with the already combined feedstock and carrier gas stream following path F2 as the feedstock/carrier gas mixture exits the axial injection port 114 past the throat 126, and the mixing of the gas stream and the feedstock/carrier gas mixture occurs downstream of the throat 126 and past the exit of the primary nozzle exit 120.

In one embodiment, when the feedstock/carrier gas mixture exits the first stage 122 and mixes with the gas stream, the velocity of the gas stream F1 in the second stage is greater than the velocity of the feedstock/carrier gas mixture F2. In another embodiment, the velocity of the gas stream F1 is supersonic when it mixes with the sonic or subsonic feedstock/carrier gas mixture.

Figure 10:
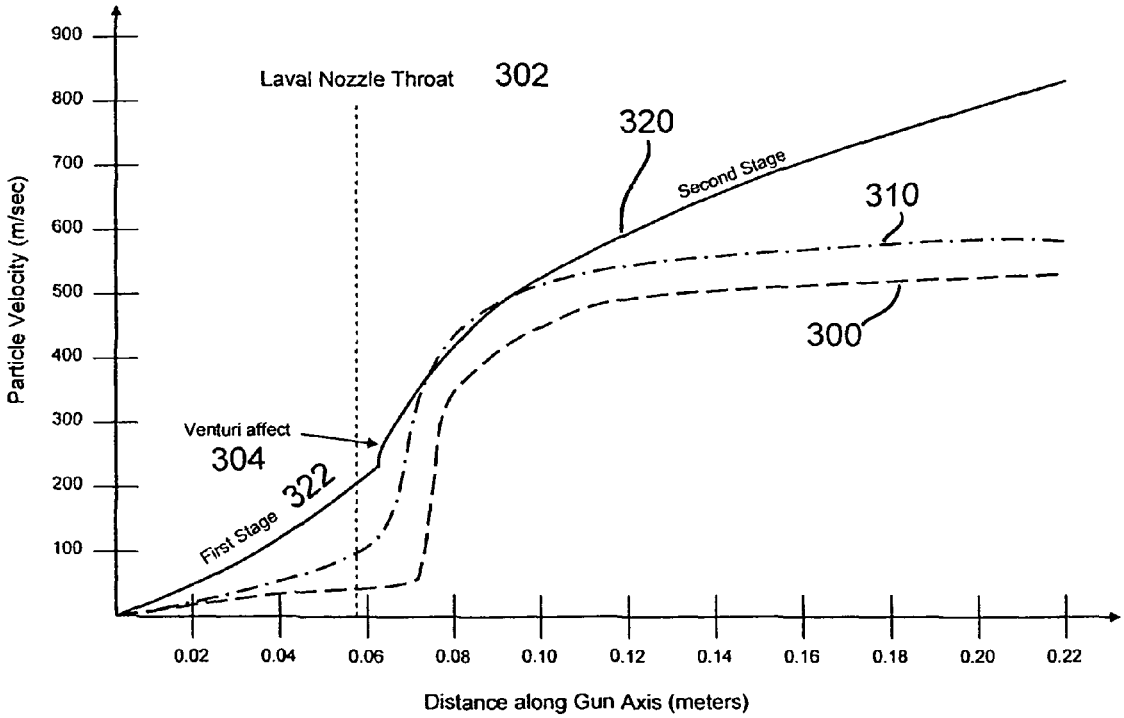
FIG. 10 depicts 2-stage particle acceleration of one embodiment of the invention.

FIG. 10 depicts a comparison of particle acceleration of a conventional cold spray device with radial injection with a two-stage kinetic device of the present invention. All gun lengths were unitized for comparison purposes. All guns were operating at the same temperature and pressure, and at ideal expansion. The data was taken using 20 micron copper particles.

Line 300 shows particle velocity versus distance along gun axis for a conventional cold spray gun with powder injection past the throat 302. Line 310 shows particle velocity versus distance along gun axis for a conventional cold spray gun with powder injection before the throat 302. Both lines 300 and 310 show rapid particle acceleration just past the nozzle throat 302, followed by a tapering off of particle acceleration shortly thereafter.

In contrast, line 320 shows particle velocity versus distance along gun axis for a two-stage kinetic gun of the invention. It can be readily seen that particle velocity increases steadily prior to the nozzle throat 302 in the first stage 322, and accelerates smoothly and continuously as the particles travel through the second stage 324. Rapid acceleration due to venture effect can be seen a occurring around the region 304 just past the throat 302.

Anyone skilled in the art can envision further enhancements to the apparatus as well as the use of shapes other than triangular for the chevrons. This apparatus will work on any thermal spray gun using axial injection to introduce particulate bearing carrier gas as well as liquids, additional effluent streams, and reactive gases.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed as new and desired to be protected by Letters Patent of the United States is:

1. A two stage kinetic energy spray device comprising:

a first stage having a first nozzle, the first nozzle having a first nozzle receiving end that receives a feedstock and carrier gas stream, and a first nozzle injection end located axially to the first nozzle receiving end, the first nozzle injection end receiving the feedstock and carrier gas stream from the first nozzle receiving end;

a second stage having a second nozzle, the second nozzle having a gas receiving portion that receives an effluent gas, a convergent portion that is downstream from the gas receiving portion and a divergent portion that is downstream from the convergent portion, the convergent portion and the divergent portion meeting at a throat of the second nozzle;

wherein the first nozzle is located annularly within the second nozzle;

wherein the first nozzle is one of a convergent nozzle and a straight nozzle;

wherein the feedstock and the carrier gas stream form a particle stream, and the particle stream is accelerated to a first velocity in the first nozzle;

wherein the effluent gas is accelerated to a second velocity in the second nozzle;

wherein the first nozzle injection end is located in the second nozzle divergent portion, and wherein the first nozzle injection end has at least one chevron.

2. The two stage kinetic energy spray device of claim 1, wherein the second velocity is greater than the first velocity.

3. The two stage kinetic energy spray device of claim 1, wherein the first velocity is less than or equal to mach 1.

4. The two stage kinetic energy spray device of claim 1, wherein the second velocity is equal to or greater than mach 1.

5. The two stage kinetic energy spray device of claim 1, wherein the gas receiving portion has at least one gas receiving port.

6. The two stage kinetic energy spray device of claim 1, wherein the first nozzle and the second nozzle are removably assembled.

7. The two stage kinetic energy spray device of claim 1, wherein the first nozzle and the second nozzle are at least one of pressure sealed, threaded, welded, brazed, swaged, and gasketed.

8. The two stage kinetic energy spray device of claim 1, wherein the particulate stream and the effluent gas mix downstream of the throat of the second nozzle.

9. The two stage kinetic energy spray device of claim 1, wherein the first nozzle is a straight nozzle.

10. A method of using a two stage kinetic energy spray device comprising the steps of:

receiving a feedstock and a carrier gas stream at a first nozzle receiving end;

axially transmitting the feedstock and the carrier gas stream through a first nozzle;

receiving the feedstock and the carrier gas stream at a first nozzle injection end;

injecting the feedstock and the carrier gas stream from the first nozzle injection end;

receiving an effluent gas at a second nozzle gas receiving portion, transmitting the effluent gas through a convergent portion of the second nozzle, the convergent portion downstream from the gas receiving portion;

accelerating the effluent gas through a divergent portion of the second nozzle that is downstream from the convergent portion, the convergent portion and the divergent portion meeting at a throat; and mixing the feedstock and the carrier gas stream with the effluent gas;

wherein the first nozzle is located annularly within the second nozzle;

wherein the first nozzle is one of a convergent nozzle and a straight nozzle;

wherein the feedstock and the carrier gas stream form a particle stream, and the particle stream is accelerated to a first velocity in the first nozzle;

wherein the effluent gas is accelerated to a second velocity in the second nozzle;

wherein the first nozzle injection end is located in the second nozzle divergent portion, and wherein the first nozzle injection end has at least one chevron.

11. The method of using the two stage kinetic energy spray device of claim 10, wherein the second velocity is greater than the first velocity.

12. The method of using the two stage kinetic energy spray device of claim 10, wherein the first velocity is less than or equal to mach 1.

13. The method of using the two stage kinetic energy spray device of claim 10, wherein the second velocity is equal to or greater than mach 1.

14. The method of using the two stage kinetic energy spray device of claim 10, wherein the gas receiving portion has at least one gas receiving port.

15. The method of using the two stage kinetic energy spray device of claim 10, wherein the first nozzle and the second nozzle are removably assembled.

16. The method of claim 10, wherein the first nozzle and the second nozzle are at least one of pressure sealed, threaded, welded, brazed, swaged, and gasketed.

17. The method of claim 10, wherein the feedstock and carrier gas stream and the effluent gas mix downstream of the throat of the second nozzle.

18. The method of claim 10, wherein the first nozzle is a straight nozzle.

* * * * *